US005368114A

United States Patent [19]

Tandberg et al.

[11] Patent Number: 5,368,114

[45] Date of Patent: Nov. 29, 1994

[54] UNDER-REAMING TOOL FOR BOREHOLES

[76] Inventors: Geir Tandberg, Berberissvn 30A, N-3408 Tranby; Sigbjørn Sangesland, Okstadbrinken 10, N-7039 Trondheim; Asbjørn Andersen, Jakobslivn. 55, N-7058 Jakobsli, all of Norway

[21] Appl. No.: 54,198

[22] Filed: Apr. 30, 1993

[30] Foreign Application Priority Data

Apr. 30, 1992 [NO] Norway ..... 921718

[51] Int. Cl.[5] ..... E21B 10/26

[52] U.S. Cl. ..... 175/267; 175/291; 175/406

[58] Field of Search ..... 175/267, 269, 274, 279, 175/281, 325.2, 325.3

[56] References Cited

U.S. PATENT DOCUMENTS

| | | | |
|---|---|---|---|
| 2,754,089 | 7/1956 | Kammerer, Jr. | 175/279 |
| 3,851,719 | 12/1974 | Thompson et al. | 175/406 |
| 4,071,101 | 1/1978 | Ford | 175/325.3 |
| 4,407,376 | 10/1983 | Inoue | 175/267 |
| 4,458,761 | 7/1984 | Van Vreeswyk | 175/269 X |
| 4,589,504 | 5/1986 | Simpson | 175/267 |
| 4,889,197 | 12/1989 | Boe | 175/267 |
| 5,074,356 | 12/1991 | Neff | 175/406 |
| 5,139,098 | 8/1992 | Blake | 175/269 |

*Primary Examiner*—Ramon S. Britts
*Assistant Examiner*—Frank S. Tsay
*Attorney, Agent, or Firm*—Cushman Darby & Cushman

[57] ABSTRACT

An under-reaming tool for use in preferably horizontal and extended reach bore holes includes a succession of stabilizers, under-reamers and expandable stabilizers. A common drilling mud activator is provided for the expandable elements of under-reamers and expandable stabilizers. A preferred under-reaming device comprises a main body with a number of guiding surfaces distributed over the circumference thereof which have a pitch increasing radially in an axial direction and with a ring collar formed as a piston in a surrounding cylinder housing having a small and a large radial annular surface, and having reaming pads/wings and/or stabilizer pads/wings in sliding contact with a respective guiding surface, the pads being taken up in ports in a jacket surrounding the main body, in such a way that the pads can only be moved radially relative to the jacket, the jacket being attached to or formed as a part of the cylinder housing.

12 Claims, 8 Drawing Sheets

UNDER-REAMING TOOL FOR BOREHOLES

BACKGROUND OF THE INVENTION

This invention relates to an under-reamer system for boreholes, especially for under-reaming horizontal and extended reach boreholes.

When, in petroleum extraction, the diameter of a section of a borehole is to be increased an under-reamer is used. The under-reamers which are found on the market today have reaming members, i.e., cutters or crushing means, secured to outwardly pivotal arms which are hinged to a main body. This construction is unfavourable with regard to strength. The arms provide little space for the cutters, and moreover it is difficult to position the accompanying nozzles for cleaning and cooling the cutters in an expedient manner. The activation of today's under-reamers is based on pressure drop across a nozzle or on the use of a ball which is sent with the mud flow from the drill floor. The possibility of putting in several under-reamers in a series, in such a way that worn-out under-reamers can be deactivated and new ones activated, is thus limited. This means to say that worn-out equipment must be hauled out of the borehole in order to be replaced by new equipment. Moreover, today's under-reamers do not have any stabilization on the upper side, which makes them poorly suited to extended reach and horizontal boreholes. Such stabilization is necessary in order to take up the lateral load which is brought upon the equipment by its own weight and that of the drill string.

SUMMARY OF THE INVENTION

A particular objective of the invention is to provide an under-reamer system where the weight of the under-reamer and the drill string is stabilized on the upper and under sides of the under-reamer, so that extended reach and horizontal boreholes can be underreamed in a more efficient manner.

Another objective of the invention is to make it possible for several sets of under-reamers and stabilizers to be assembled in a series and activated independently of one another, in such a way that a worn-out under-reamer can be deactivated and a new one activated without the equipment being hauled out of the borehole.

Yet another objective of the invention is to obtain a new and robust structural embodiment which will increase the life time of the under-reamer.

Still yet another objective of the invention is to obtain equipment which is of limited complexity, achieved in that the same basic structure is used for expansion both in the under-reamer itself and in the variable stabilizers.

A further objective of the invention is to provide an under-reamer and stabilizer which can be activated jointly, or independently of one another.

It is also an objective of the invention to form the stabilizer and under-reamer as independent units which can be be screwed into the drill string spaced apart at a distance which is expedient at all times and with an appropriate number of the two types of units.

Yet another objective of the invention is to avoid the use of dropping objects in the drill string, or the use of definite demands on the mud flow over a period of time for activating the individual units.

According to the invention, an under-reamer system is therefore suggested as mentioned by way of introduction, characterized by an under-reamer with one or more fixed or expandable stabilizers on the under side (i.e., in the pilot hole) and one or more expandable stabilizers on the upper side (in the reamed hole).

According to the invention, an under-reamer is thus placed between at least two stabilizers. The stabilizer(s) which are placed on the upper side of the under-reamer are variable, so as to be adaptable to the diameter to which the borehole is reamed. On the underside, fixed stabilizers are used. If necessary or desirable, variable stabilizers may, of course, also be used here, up to the diameter which fits the dimension of the hole from which it is reamed. The last-mentioned will also be relevant on the upper side in order to obtain stability during the expansion of the under-reamer.

It is especially advantageous for the under-reamers and the expandable stabilizers to have the same fundamental structure with regard to the expansion, with the same type of activator or a common activator for the reaming members and the expandable stabilizers. This limits the complexity of the structure.

It is particularly advantageous to be able to use a drilling mud-driven activator for the under-reamer (and for the stabilizers). An especially favourable embodiment is one where the drilling mud-driven activator comprises a drilling mud driven double-acting hydraulic cylinder with differing piston areas. It is particularly beneficial that the smallest piston area can be actuated by the pipe mud pressure whilst the greatest piston area can be actuated alternately by the pipe mud pressure and the annulus mud pressure. The area differences are harmonized in such a way that the correct activation power is obtained when the annulus pressure acts upon the large piston area. When the equipment is to be deactivated or is to remain passive there must be pipe pressure on both sides of the piston. There is, thus, only pressure on one side of the piston which needs to be manipulated. This manipulation is restricted to alternating between pipe pressure to annulus pressure. According to the invention, an either/or valve can be used in a simple manner in this connection for selectively admitting pipe mud pressure and annulus mud pressure, said valve being controlled by an electric starting device which is, in turn, controlled by a microprocessor which acts on orders from the drill floor from where suitable codes are transmitted. If pulse codes are transmitted they are intercepted by a pressure sensor connected to the microprocessor. Alternatively, codes may be transmitted in the form of speed and feed variations which can be intercepted by an accelerometer connected to the microprocessor. The microprocessor will recognize the individual code and set in motion the action which responds to said code. The activation of the under-reamer and the stabilizers can, thus, be started by a common code or by a separate individual code. Since it is possible to operate with an unlimited number of codes, it is possible to put several under-reamers and stabilizers in a series and operate them independently of one another. If, because of an error, it is not possible to manipulate the pressure in the hydraulic cylinder, the equipment can be deactivated by stopping circulation. The pressure will then be equal on either side of the piston.

The under-reamer can expediently comprise a spring which brings the mud-driven hydraulic cylinder into the deactivation position. It is particularly expedient, in this connection, for a one-way valve to be provided between the annulus of the borehole and the chamber in the hydraulic cylinder which has the greatest piston area. Hydraulic locking is thereby prevented because the one-way valve will allow the mud to flow into the chamber with the greatest piston area.

It is especially expedient for the inlet for the annulus mud to be equipped with a strainer which prevents particles in said mud from entering the valves and the activation cylinders.

It is particularly expedient according to the invention, for the reaming members of the under-reamer to be in the form of pads or wings which are in sliding contact with a respective guide having a pitch which increases radially in an axial direction backwards towards the start of the borehole.

It is particularly expedient for the stabilizers correspondingly to also be in the form of pads or wings which are in sliding contact with a respective guide having a pitch which increases radially in an axial direction backwards towards the start of the borehole.

The structure will be such that if the reamer pads or stabilizer wings strike against an edge during withdrawal, the forces which then arise will contribute positively towards deactivating the equipment. This structure is also exploited on activation, because it allows the contact forces between the cutter pad or stabilizer wing and the wall of the borehole to contribute positively to the equipment assuming an active position.

The structure of the under-reamer/stabilizer, described herein, has independent inventive significance comprising a main body with a number of guiding surfaces distributed over the circumference with a pitch increasing radially in an axial direction backwards towards the start of the borehole and with a ring collar, formed as a piston in a surrounding cylinder housing, having a small and a large radial annular surface, and with reaming pads/wings and/or stabilizer pads/wings in sliding contact with one of the respective guiding surfaces, the pads/wings being taken up in ports in the surrounding jacket of the main body, in such a way that the pads/wings can only be moved radially relative to the jacket, the jacket being secured to or formed as a part of said cylinder housing.

In order to direct the flow of cleaning/cooling agent against the cutting sides of the reaming pads, nozzles can advantageously lead into the jacket for directing a flow of an agent this kind towards the cutting side. It is especially advantageous for the duct between the nozzles and the internal mud flow of the drill string to be provided with a valve which opens for the flow of mud, as the reaming pads are pushed outwards (activated). The cavities of the jackets for both the under-reamer and the stabilizers can advantageously be provided with a valve for the through passage of pure drilling fluid, the valve being actuated and held open by a cam on the underside of a pad or wing when this is in an intermediate position (between completely out and completely in).

The reaming members can especially advantageously be equipped with cutters or abrasives embedded in a matrix where the active substance is industrially produced diamond, natural diamond and/or a ceramic materials or in other words, all types of cutting materials for cutting rock and sediments, known as of today.

BRIEF DESCRIPTION OF THE DRAWINGS

The invention shall now be explained in more detail with reference to the drawings, where.

DETAILED DESCRIPTION

Figure 1A:
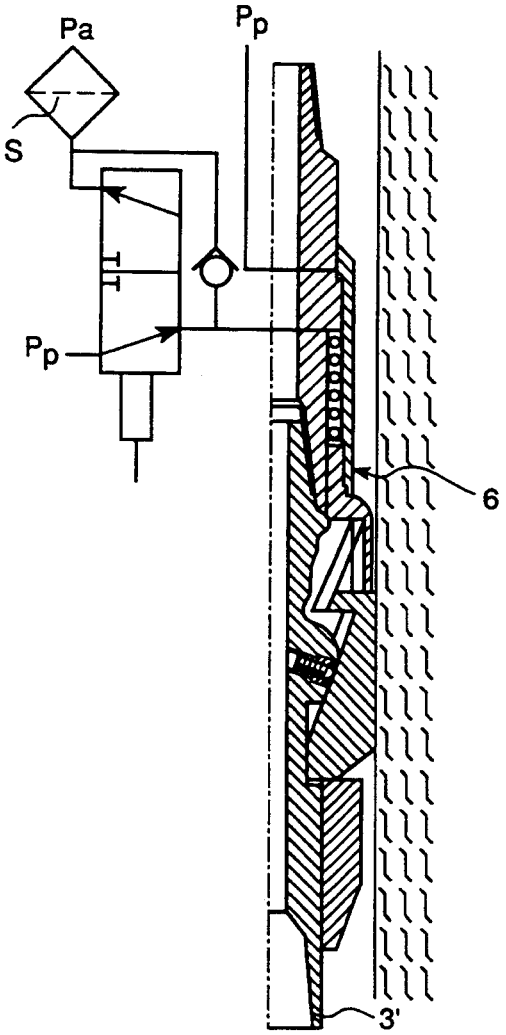
FIGS. 1(*a*), 1(*b*), 2(*a*), 2(*b*) and 2(*c*) show a principle outline of a system for underreaming horizontal and extended reach boreholes, on the drawing illustrated as a variable stabilizer FIG. 1(*a*), an under-reamer FIGS. 1(*b*)–2(*c*) and a fixed stabilizer FIGS. 1(*b*) and 2(*b*) in the form of separate units, in a deactivated FIG. 1(*b*) and activated FIG. 2(*b*) position, respectively.
Figure 1B:
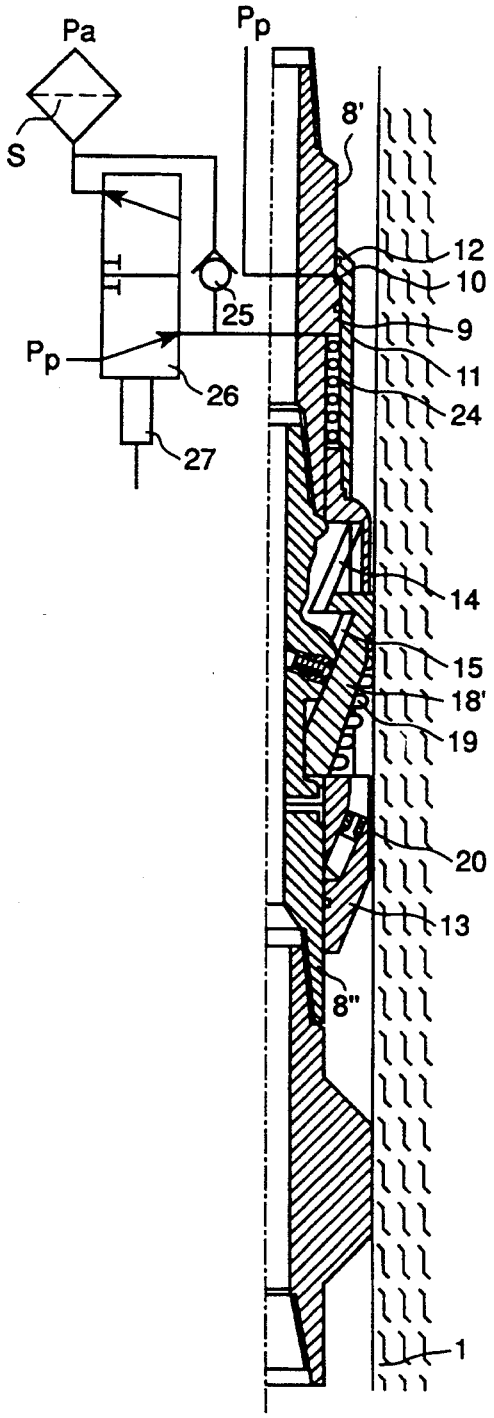
Figure 2A:
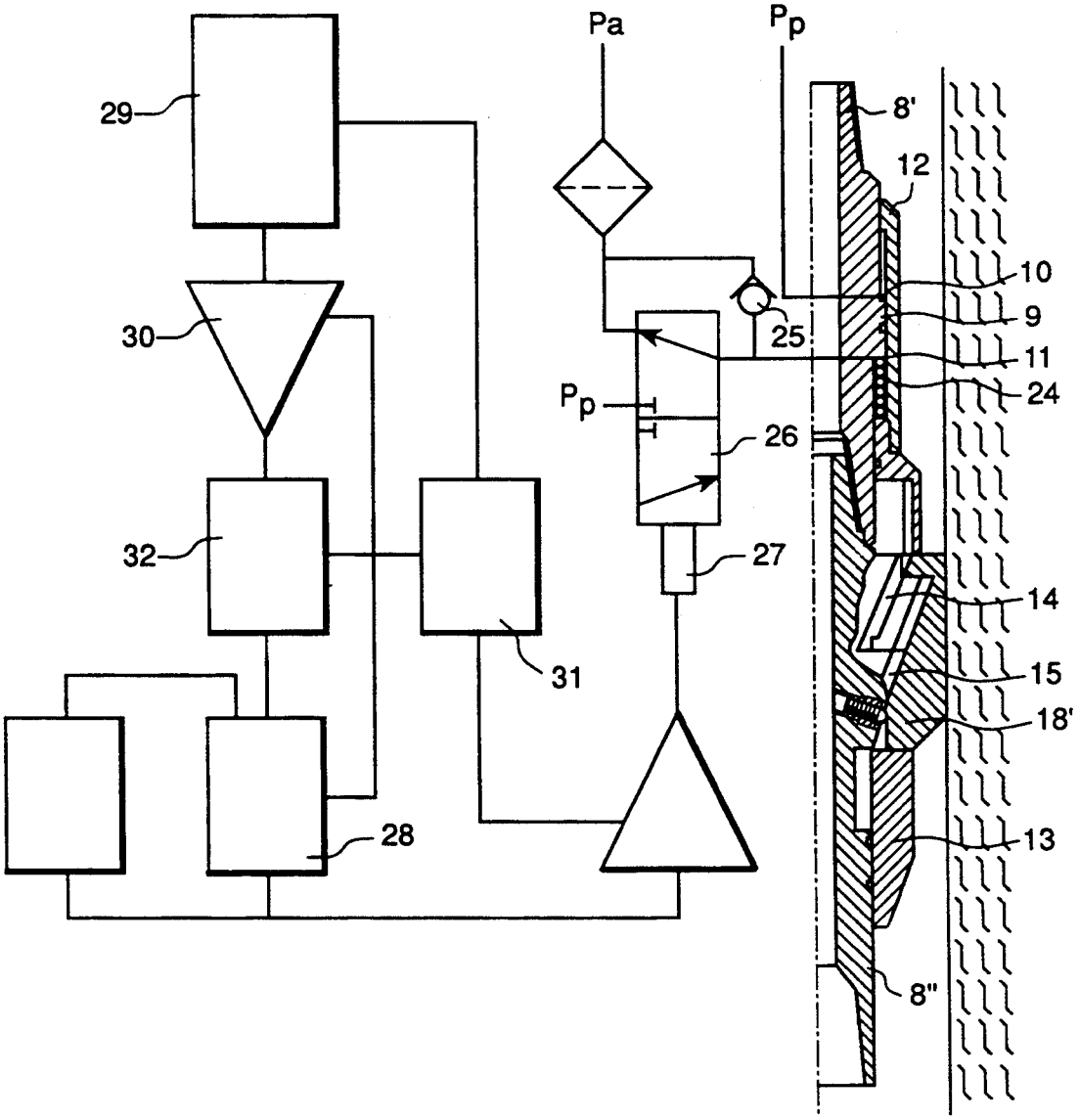
Figures 2B, 2C:
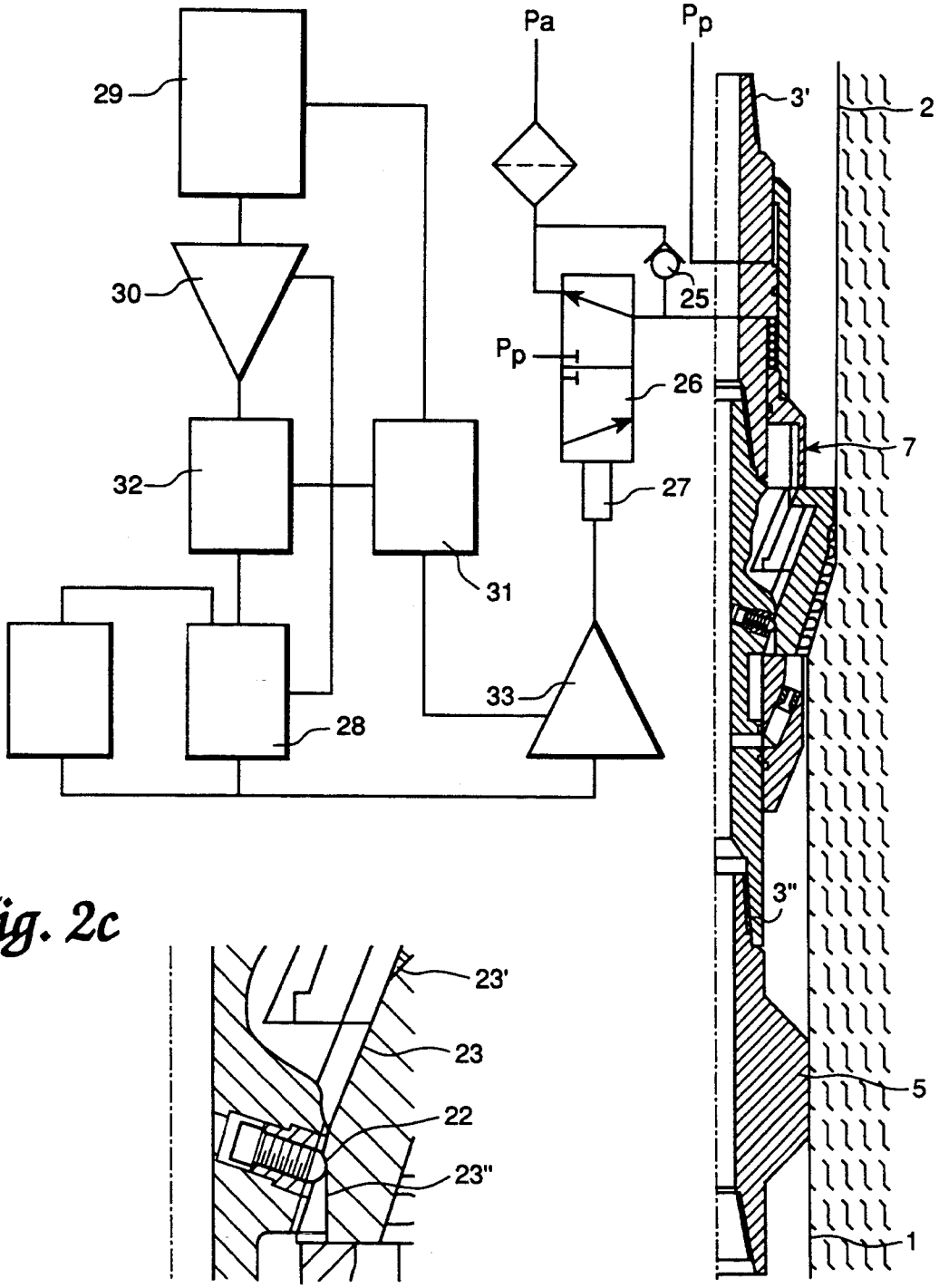

In FIGS. 1(*a*)–2(*c*), the fundamental structure of an under-reamer system, according to the invention is shown purely schematically in half section in a borehole, FIGS. 1(*a*) and 1(*b*) showing the under-reamer and stabilizer in a passive position in a not-yet-reamed borehole, and FIGS. 2(*a*), 2(*b*) and 2(*c*) showing the under-reamer and stabilizer in an active position, where a part of the borehole has been reamed.

In FIGS. 1(*a*)–2(*b*), the wall of the borehole is indicated by the reference numeral 1, and in FIG. 2(*b*) the reamed section of the borehole is marked with the reference numeral 2. The threaded connection 3' one part of which is shown at the bottom in FIG. 1(*a*) and the other part of which is shown at the top in FIG. 1(*b*), constitutes the connection between the variable stabilizer 6 and the under-reamer 7, whilst the threaded connection 3" constitutes the connection between the under-reamer 7 and a fixed stabilizer 5. The variable upper stabilizer 6 and the under-reamer section 7 have the same fundamental structure or basic structure. The embodiment of the under-reamer section shall be explained in more detail, with particular reference to FIGS. 3–11. To the extent that nothing else is said, the same is true for the structural embodiment of the variable stabilizer 6. The under-reamer, shown schematically in FIGS. 1(*b*)–2(*c*), is shown as one unit, but, in effect, the under-reamer is composed of tubular sections of the kind shown in FIGS. 3–7, the stabilizer 6 having, as mentioned, the same structure, with the exception of the expandable pads or wings, which do not have cutters or abrasive elements on the stabilizer and which are designated expandable stabilizer wings 18'. Nor do the nozzles 20 with duct 21 form a part of the stabilizer.

Figure 3:
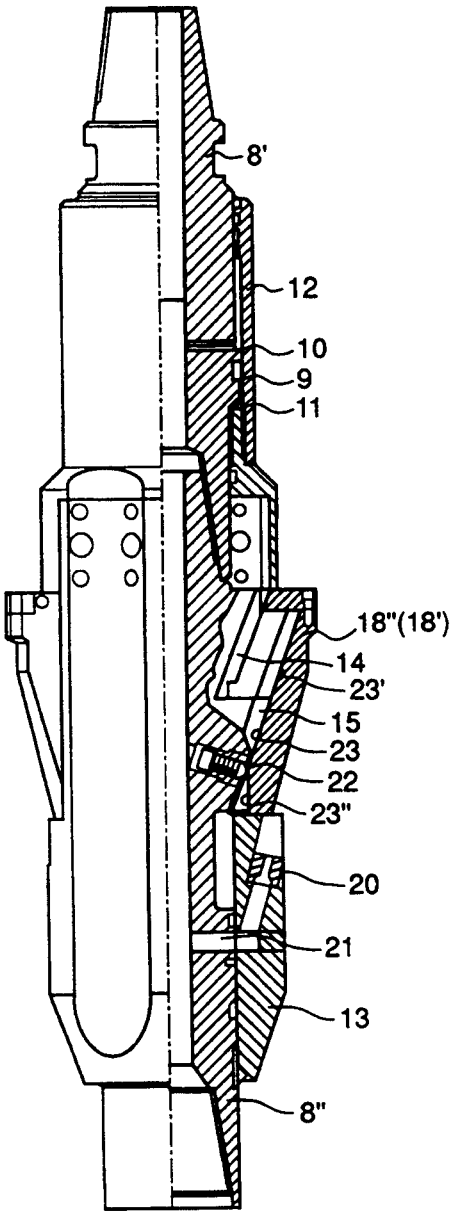
FIG. 3 shows a half section through the actual under-reamer, according to the invention (which, in principle, is the same as the stabilizer with the exception of the form of the pads and the presence of a nozzle stream), in the active position.
Figure 4:
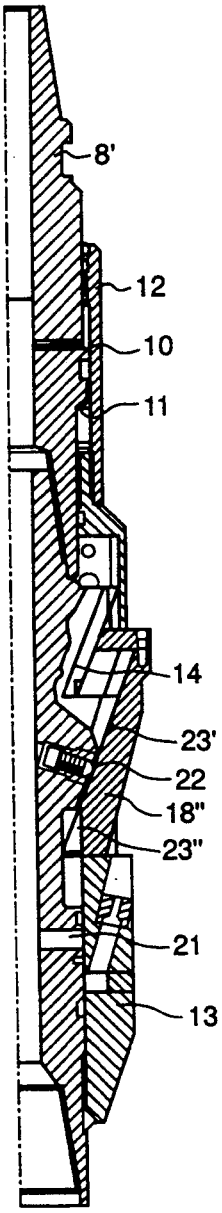
FIG. 4 shows a half section through the embodiment in FIG. 3 in an intermediate position.
Figure 5:
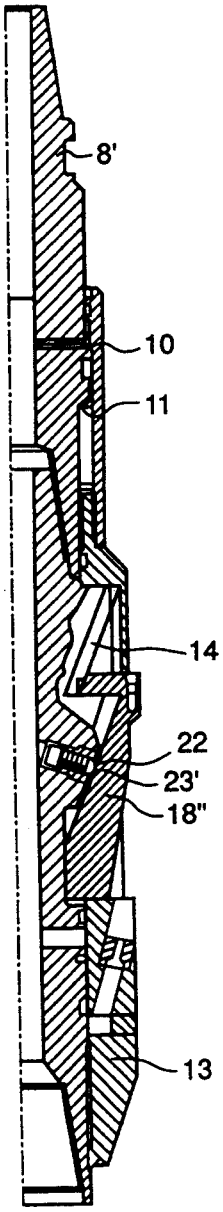
FIG. 5 depicts the under-reamer in FIG. 3 in a passive position.
Figure 6:
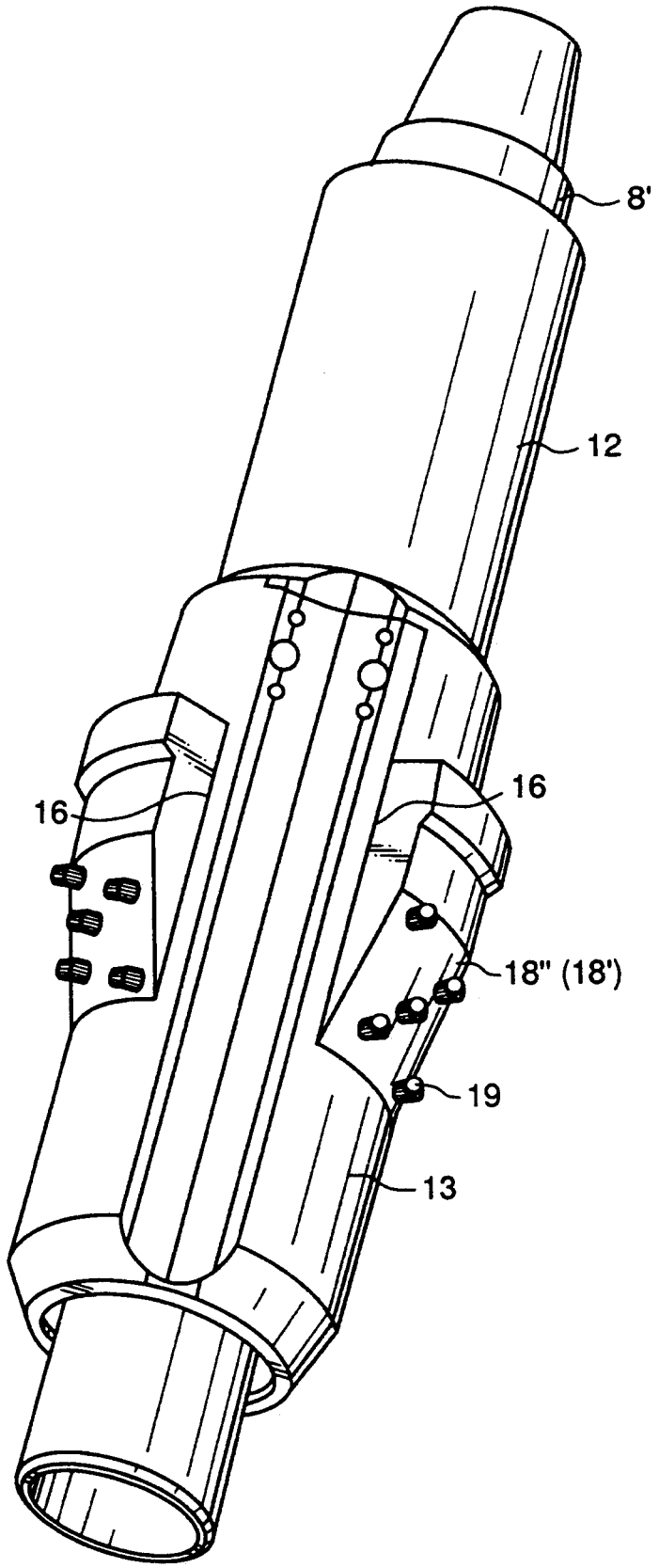
FIG. 6 shows a perspective outline of the under-reamer illustrated in FIG. 3.
Figure 7:
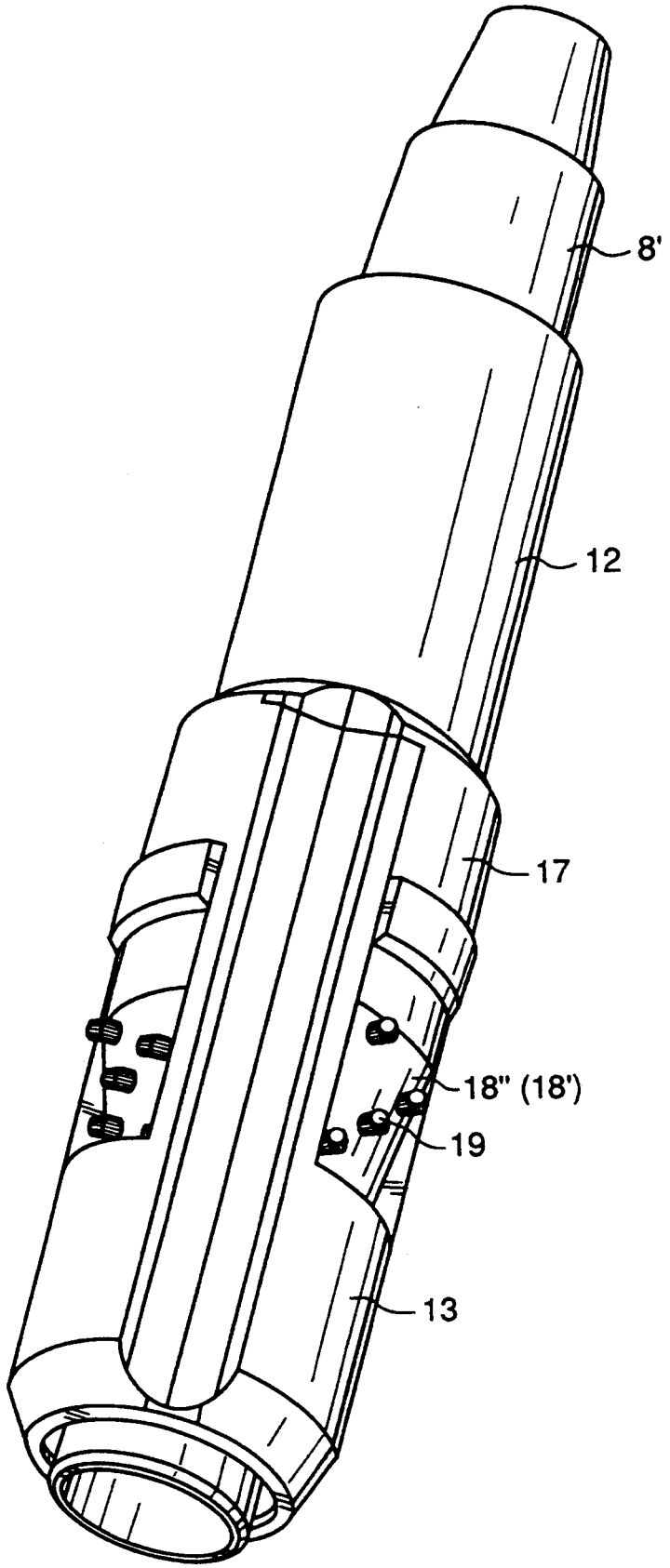
FIG. 7 shows a corresponding perspective outline of the under-reamer, corresponding to the position illustrated in FIG. 5.
Figure 8:
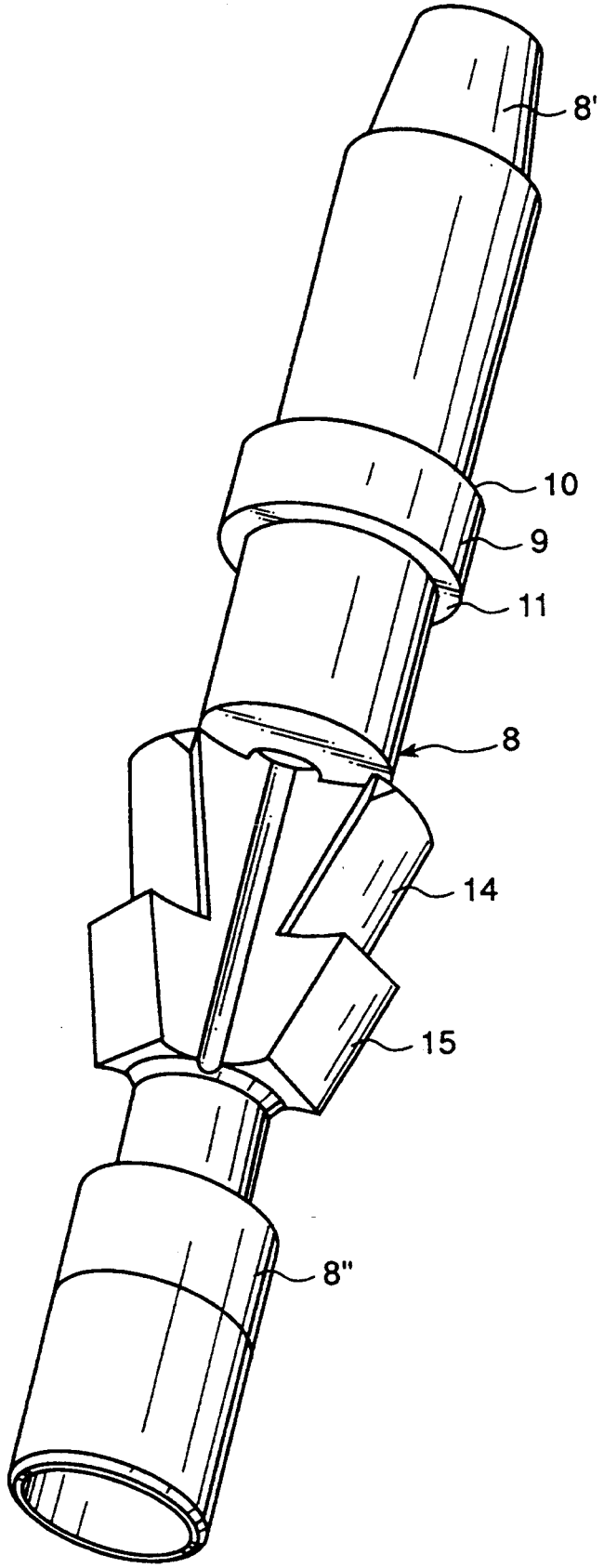
FIG. 8 shows a main body, which forms a part of the under-reamer in FIGS. 3–7.

The under-reamer section shown in FIGS. 6 and 7 in a perspective outline has a main body 8 as shown in FIG. 8. This main body is, as can be seen from the half sections in FIGS. 3–5, made up of two tubular parts 8′, 8″, which are screwed together. On the main body tubular part 8′, a ring collar 9 is formed having an upper radial annular surface 10 and a greater lower radial annular surface 11. This ring collar 9 functions as a piston in a double-acting hydraulic cylinder, the cylinder housing of which is formed by a cylinder housing 12, slidable on the main body tubular part 8′. The cylinder housing 12 is screwed together with a jacket 13 which is slidably mounted on the main body 8, i.e., on both main body tubular part 8′ and 8″, as can be seen in FIGS. 3–5.

Figure 9:
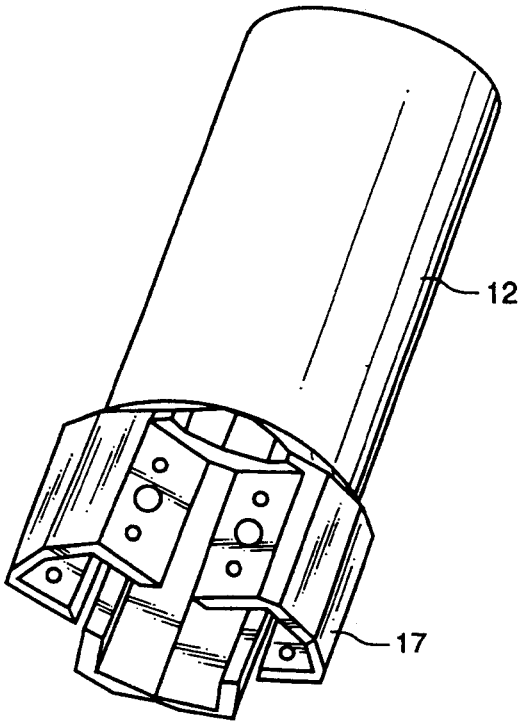
FIG. 9 shows a perspective outline of a cylinder housing, which is a component of the under-reamer in FIGS. 3–7.
Figure 10:
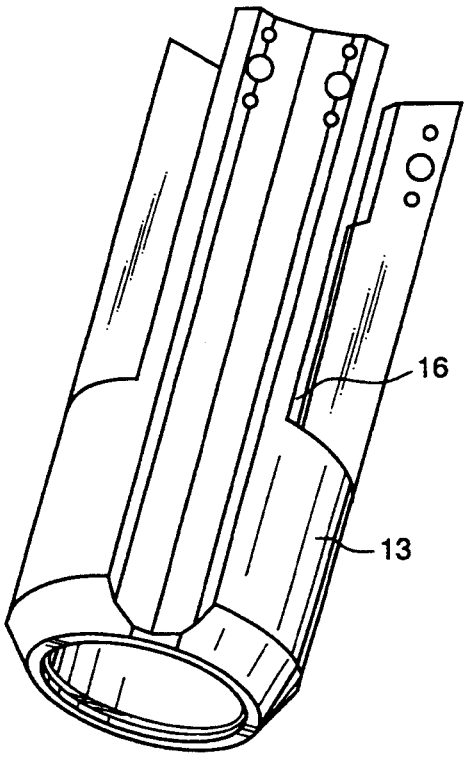
FIG. 10 shows a perspective outline of a jacket, which is a component in the under-reamer in FIGS. 3–7.
Figure 11:
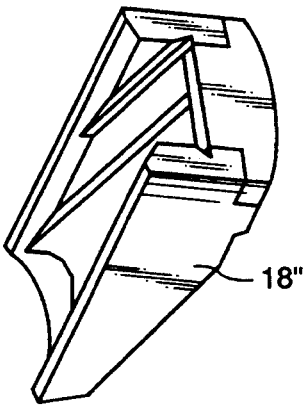
FIG. 11 shows a perspective outline of a reaming member, which is a component of the under-reamer in FIGS. 3–7.

The main body 8 is, as mentioned, shown in perspective outline in FIG. 8, whilst the cylinder housing and jacket are illustrated in perspective outline in FIGS. 9 and 10, respectively.

On the main body 8, more closely defined on the main body tubular part 8″, inclined ramps 14,15 are formed. These form guides or guiding surfaces which have a pitch which increases radially in an axial direction backwards towards the start of the borehole. In the jacket 13, there are ports 16, made by coupling together the jacket 13 and the extended coupling part 17 of the cylinder housing 12. Reaming members in the form of cutting pads 18″ are placed in these ports. The cutting pads grip around and slide along the angular inclined ramps 14,15. As shown, the angular inclined ramps and the cutting pads engage in a swallowtail sliding connection. The ports 16 in the jacket are made and dimensioned in such a way that the cutting pads 18″ can only move radially relative to the jacket 13. Upon the relative movement occurring between the main body 8 and the unit formed by the cylinder housing 12 and the jacket 13, the inclined ramps 14,15 will be pushed relative to the reaming or cutting pads 18″ fixed in the jacket 13 in an axial direction, and, thus, the cutting pads will be moved radially inwards and outwards, respectively, from an active underreaming position as shown in FIG. 3 and to a passive position, as shown in FIG. 5, and vice versa.

The cutting pads 18″ have cutters 19 and, for the cooling thereof, a stream of cleaning/cooling agent is sent through nozzles 20. This stream passes out of the nozzles 20 in the active phase only, the agent being supplied by being fed through radial ducts, the connection to which is interrupted when the jacket 13 is moved downwards to the passive position, as is illustrated in FIGS. 3–5.

The cavity in the jacket 13 is cleaned in the embodiment example, with pure drilling fluid during activation and deactivation in that a valve 22 is held open by a cam 23 on underside of the cutting pad when the pad is in an area between completely in and completely out. The cam 23 forms, in effect, the underside of the cutting pad, there being formed a notch 23′ and a cutout 23″.

The cylinder housing 12 is actuated by a spring 24, see FIGS. 1(*a*)–2(*c*). The spring is not drawn in on FIGS. 3, 4 and 5. The spring 24 functions as shown in FIGS. 1(*a*)–2(*c*) against the cylinder housing 12 and contributes to deactivation. In order to prevent hydraulic self-locking, there is a chamber in the cylinder housing 12 where the greatest piston ring surface 11 is found, in which is provided a one-way valve 25 which allows drilling mud to flow into the chamber. The chamber is, in addition, provided with an either/or valve 26 for the drilling mud. This valve is controlled by an electric device 27, which, in turn, is controlled by a microprocessor 28. The microprocessor acts on orders from the drill floor from where, for example, pulse codes can be transmitted. The control system is illustrated in detail in FIGS. 2(*a*) and 2(*b*) only, where 29 is a pressure transducer, 30 a booster, 31 a battery pack, 32 an A/D converter and 33 a booster.

In FIGS. 1(*a*)–2(*b*), the pipe pressure is indicated by Pp and the annulus pressure by Pa. On the side of the piston 9, where the smaller piston ring surface is to be found, the hydraulic cylinder is, thus, activated by pipe pressured, whilst the greater piston ring surface 11 is activated by pipe pressure or annulus pressure. The activation system is, thus, served only by manipulating pressure on the greater piston surface 11. A strainer for the annulus mud is indicated by the reference letter S.

As mentioned, the stabilizer 6 has the same basic structure as the under-reamer 7 and functions, therefore in the same way when a pulse code is transmitted from the drill floor.

Several under-reamers can be put in a series, with the possibility of independent operation, because it is possible to operate with an unlimited number of codes which are recognized by the respective microprocessor. Thus, several sets can be used in a drill string. These sets can be activated and deactivated independently of one another, and within each set, each unit can be activated and deactivated independently of one another by each one having its own code, or all the units can be operated jointly by the use of a common code set.

Having described our invention, we claim:

1. A tubular under-reaming tool for use in a longitudinal direction of movement in a well borehole for radially enlarging the well borehole from a smaller diameter to a larger diameter, while incorporated at an axially intermediate location in a string of drill pipe, said under-reaming tool comprising:

a first stabilizer, an under-reamer and a second stabilizer, respectively, connected to one another in series with said first stabilizer leading and said second stabilizer trailing, in said longitudinal direction of movement;

said under-reamer being radially expansible to an active position and radially contractible to an inactive position;

said second stabilizer being radially expansible, for effectively providing stabilization of said under-reaming tool in said borehole in a radially contracted position for use while located where said borehole has said smaller diameter and in a radially expanded position for use while located where said borehole has said larger diameter.

2. The under-reaming tool of claim 1, further including:

a first actuator effectively connected with said under-reamer for radially expanding said under-reamer; and a second activator effectively connected with said radially expansible stabilizer for radially expanding said radially expansible stabilizer.

3. The under-reaming tool of claim 2, wherein:

each said activator is a drilling mud-operated activator, operated by hydraulic pressure exerted thereon by drilling mud circulated into the borehole in communication with the respective said activator.

4. The tubular under-reaming tool of claim 3, wherein:

each said activator includes a hydraulic cylinder housing, a movable piston having a first, larger area axially facing surface, and a second, smaller area oppositely axially facing surface; and an arrangement for exposing said smaller area to drilling mud at pipe pressure only from within said tool, and for exposing said larger area to drilling mud selectively at pipe pressure from within said tool and at annulus pressure from between said tool and said borewall.

5. The tubular under-reaming tool of claim 4, further including:

a two-way valve operatively connected with a respective said activator, for selectively exposing said larger area to drilling mud at said pipe pressure and at said annulus pressure;

an electrically operated starting device operably connected with said two-way valve, for operating said valve; and a microprocessor operably connected with said electrically operated starting device for selectively causing electrical operation of said starting device, upon receipt of codes transmitted to said microprocessor from remotely of said under-reaming tool.

6. The tubular under-reaming tool of claim 4, further including:

a spring provided in a respective said actuator and effectively bearing against the respective said piston and said cylinder for biasing the respective said piston in a direction such as to tend to radially contract the respective of said second stabilizer and said under-reamer.

7. The tubular under-reaming tool of claim 6, further comprising:

a two-way valve operatively connected with a respective said activator, for selectively exposing said larger area to drilling mud at said pipe pressure and at said annulus pressure; and wherein said two-way valve is served by an inlet line for drilling mud at pipe pressure, an inlet line for drilling mud at annulus pressure, an outlet line for drilling mud at pipe pressure, an outlet line for drilling mud at annulus pressure; said outlet lines for drilling mud at pipe pressure and at annulus pressure join downstream of said two-way valve to form a common line communicating through the respective said cylinder to the respective said larger area of the respective said piston; and a one-way valve oriented so as to prevent backflow through said outlet line for drilling mud at annulus pressure.

8. The tubular under-reaming tool of claim 1, wherein:

each of said under-reamer and said second stabilizer includes a respective tubular main body arranged to be longitudinally aligned in said longitudinal direction of movement, or respective plurality of pads or wings mounted on the respective said main body for radial movement to provide the respective said active or radially expanded position and the respective said inactive or radially contracted position; each said piston being provided on the respective said main body; each said cylinder surrounding the respective said main body and being coaxial with the respective said main body and the respective said piston; and a respective plurality of guides fixed on the respective said main body; each pad or wing being disposed in sliding contact with a respective said guide along respective surfaces which are effectively pitched relative to the longitudinal axis of said under-reaming tool, such that upon axial movement of the respective said cylinder in one direction, the respective said guides force the respective said pads or wings to progressively move from said inactive or radially contracted position to said active or radially expanded position, and upon axial movement of the respective said cylinder in an opposite direction, permits the respective said pads or wings to progressively move from said active or radially expanded position to said inactive or radially contracted position;

said pads or wings of said under-reamer being provided with cutters on outwardly presented surfaces thereof.

9. A tubular under-reaming tool for progressively enlarging the diameter of a horizontal or extended-reach borehole from a smaller diameter to a larger diameter, while incorporated at an axially intermediate location in a pipe string which is being advanced in a longitudinal direction of advancement in the borehole, so that an annulus is defined radially between the pipe string and the borehole, said under-reaming tool comprising:

an under-reamer which is radially expansible to an active position and radially contractible to an inactive position;

an activator effectively connected with said under-reamer for radially expanding said under-reamer;

said activator being a drilling mud-operated activator, operated by hydraulic pressure exerted thereon by drilling mud circulated into the borehole in communication with said activator;

said activator includes a hydraulic cylinder housing, a movable piston having a first, larger area axially facing surface, and a second, smaller area oppositely axially facing surface; and an arrangement for exposing said smaller area to drilling mud at pipe pressure only from within said tool, and for exposing said larger area to drilling mud selectively at pipe pressure from within said tool and at annulus pressure from between said tool and said borewall;

mounted on said main body for radial movement to provide said active position and said inactive position; said piston being provided on said main body; said cylinder surrounding said main body and being coaxial with said main body and said piston; and a plurality of guides fixed on said main body; each pad or wing being disposed in sliding contact with a respective said guide along respective surfaces which are effectively pitched relative to the longitudinal axis of said under-reaming tool, such that upon axial movement of said cylinder in one direction, said guides force said pads or wings to progressively move from said inactive position to said active position, and upon axial movement of said cylinder in an opposite direction, permits said pads or wings to progressively move from said active position to said inactive position;

said pads or wings being provided with cutters on outwardly presented surfaces thereof;

said pads or wings being radially outwardly exposed through respective parts formed in a tubular jacket which is unitary with said cylinder as a coaxial extension of said cylinder.

10. The tubular under-reaming tool of claim 9, further including:

a plurality of nozzles formed in said jacket and arranged to be served via respective ducts through said body with a supply of liquid;

said nozzles being directed towards respective of said outwardly presented surfaces of said pads or wings, whereby liquid cleaning and cooking agent can be directed towards said cutters.

11. The tubular under-reaming tool of claim 9, further including:

a plurality of normally closed valved openings through said body and arranged for streaming drilling mud from within said body to a respective region radially behind each said pad or wing; and a cam on each said pad or wing arranged for opening the respective normally closed valved opening only when the under-reamer is disposed intermediate said active and inactive position thereof.

12. The tubular under-reaming tool of claim 9, wherein:

each of said cutters comprises an abrasive body set in a matrix, said abrasive body being one selected from the group consisting of industrially prepared diamond, natural diamond and ceramic material.

* * * * *